United States Patent [19]

Penven

[11] Patent Number: 4,892,781

[45] Date of Patent: Jan. 9, 1990

[54] BASE FABRIC STRUCTURES FOR SEAMED WET PRESS FELTS

[75] Inventor: Patrick H. Penven, Clinton, S.C.

[73] Assignee: Asten Group, Inc., Charleston, S.C.

[21] Appl. No.: 318,727

[22] Filed: Mar. 3, 1989

Related U.S. Application Data

[62] Division of Ser. No. 108,491, Oct. 14, 1987, Pat. No. 4,824,525.

[51] Int. Cl.[4] ..... B32B 5/02

[52] U.S. Cl. ..... 428/234; 428/222; 428/223; 428/246; 428/300

[58] Field of Search ..... 428/221, 222, 223, 234, 428/300, 246

[56] References Cited

U.S. PATENT DOCUMENTS

| | | | |
|---|---|---|---|
| 2,883,734 | 4/1959 | Draper | 28/141 |
| 2,907,093 | 10/1959 | Draper, Jr. | 28/72 |
| 3,546,330 | 12/1970 | Thompson | 28/141 |
| 3,657,068 | 4/1972 | Ivanowicz | 162/358 |
| 3,815,645 | 6/1974 | Codorniu | 139/383 |
| 3,928,699 | 12/1975 | Fekete | 428/212 |
| 4,141,388 | 2/1979 | Romanski et al. | 139/383 |
| 4,162,190 | 7/1979 | Ashworth | 162/359 |
| 4,186,780 | 2/1980 | Josef et al. | 139/383 |
| 4,199,401 | 4/1980 | Liu et al. | 162/358 |
| 4,244,084 | 1/1981 | Gisbourne | 28/141 |
| 4,356,225 | 10/1982 | Dufour | 428/234 |
| 4,364,421 | 12/1982 | Martin | 139/383 |
| 4,401,137 | 8/1983 | Cannon | 139/383 |
| 4,403,632 | 9/1983 | Romanski et al. | 139/383 |
| 4,410,015 | 10/1983 | Keller et al. | 28/141 |
| 4,414,263 | 11/1983 | Miller et al. | 428/234 |
| 4,420,529 | 12/1983 | Westhead | 428/244 |
| 4,425,392 | 1/1984 | Oikawa et al. | 428/90 |
| 4,438,789 | 3/1984 | MacBean | 139/383 |
| 4,469,142 | 4/1984 | Harwood | 139/383 |
| 4,564,985 | 1/1986 | Tanabe | 28/142 |
| 4,601,785 | 7/1986 | Lilya et al. | 28/141 |
| 4,683,624 | 8/1987 | Dufour | 28/141 |
| 4,695,498 | 9/1987 | Sarrazin et al. | 428/257 |
| 4,705,601 | 11/1987 | Chen | 162/348 |

*Primary Examiner*—James J. Bell

*Attorney, Agent, or Firm*—Volpe and Koenig

[57] ABSTRACT

A papermaker's wet press felt is formed from a flat woven base fabric having the crimped warp yarns of the fabric weave oriented in the lengthwise machine running direction. The warp yarns are formed into seaming loops at the ends of the base fabric which are joined so as to form an endless felt. At least one layer of non-woven batt material is affixed to the base fabric, typically by needling. The flat woven base fabric includes from at least 30 to 50 machine direction, crimped warp yarns per inch for a single layer weave and at least 60 to 100 machine direction, crimped warp yarns per inch for a multi-layer weave.

4 Claims, 3 Drawing Sheets

BASE FABRIC STRUCTURES FOR SEAMED WET PRESS FELTS

This is a divisional of application Ser. No. 108,491, filed 10/14/87 now U.S. Pat. No. 4,824,525.

BACKGROUND

In the manufacturing of paper, papermaker's machines are employed which typically comprise a forming section, a press section and a dryer section. The three sections of a typical papermaker's machine sequentially remove water from a paper furnish to form a paper sheet. In the forming section, the furnish, comprising about 75 to 80 percent by weight water, is deposited on a moving forming wire, and water is drained through the wire to form a still wet paper web or sheet. In the press section, the wet web, carried by a wet press felt, passes through one or more roller nips to further remove water. In the final dryer section, the web, oriented on a dryer felt, is pressed against steam heated cylinders to form a final sheet.

The felts or belts employed to transport the furnish and web through the papermaking machine must be particularly adapted to accommodate the unique conditions encountered in the various sections of the papermaking machine. Due to the difference in operating conditions between the sections, the felts for each section are generally manufactured to specific design parameters.

In the wet press section, where a larger percentage of the water is removed, the properties of the felt are critical to the efficient operation of the papermaking machine. The materials and construction of a typical wet press felt have evolved as papermaking machines have been improved. Currently, papermaking machines may operate at speeds of up to 4,000 to 5,000 feet per minute. A wet press felt must be capable of operating continuously at such speeds while providing for maximum drying in order to minimize energy requirements in the dryer section and to minimize breakage of the sheet (sheet strength increases as the water content of the sheet decreases). Additionally, the felt must have a sufficient life to minimize costly down time of the machine for felt replacement. Currently, a standard wet press felt comprises a woven fabric base, either single or multi-ply, to which is affixed at least one layer of batt material comprising non-woven fibers. Typically, the batt layer is affixed to the fabric base by needling, an operation well known to a person of ordinary skill in the art. A variety of other constructions are sometimes employed to form wet press felts such as non-woven felts or felts having laminated layers.

The base fabric of a wet press felt must provide sufficient strength to allow high speed, extended operation while being resistant to compaction and provide adequate dewatering and air permeability properties. Also, the base fabric is preferably formed so as to have minimal effects on the smooth surface of the batt layers supported thereon.

Typically, wet press felts are woven as endless loops so that changes in overall felt length during the life to the felt are minimized. By weaving the felts as endless loops, the crimped warp yarns are oriented in the cross-machine direction when the felt is actually placed on the machine. Thus, possible stretching of the felts by "flattening" of the fabric crimp is minimized. Also, such endless loops avoid marking problems associated with seamed felts. However, such endless felts are difficult to weave and provide with batt layers and are difficult to install on papermaking machines.

Generally, the industry has not employed a wet press felt which is woven flat and joined by a seam. In a typical flat woven fabric joined by a seam into an endless felt, the machine-direction warp yarns are crimped during weaving. The elastic effect in such a felt, coupled with the possibility of product marking and weakness of the seam, are believed to have resulted in a generally lack of use of seamed felts as wet press felts.

The wet press felt of the present invention is an improved wet press felt which is easier and more economical to form. Installation in a typical papermaking machine requires less down time due to the use of a seam, and the present invention provides a wet press felt which exhibits good operating life and physical properties.

SUMMARY OF THE INVENTION

The wet press felt of the present invention comprises a papermaking machine felt having a woven base fabric with the crimped warp yarns oriented lengthwise in the machine direction. The warp yarns are formed into seaming loops at the ends thereof and the felt is formed into a endless loop. The fabric base has affixed thereto, generally by needling, at least one layer of non-woven batt material. The batt material not only provides a smooth forming surface, but also helps to control elastic deformation of the base fabric in the machine direction. Orientation of the crimped warp yarns in the machine direction when the flat woven felt is formed into an endless loop, allows a higher machine direction yarn count that prior art wet press felts.

The present invention also includes a method of forming a wet press for a papermaker's machine which comprises weaving a flat fabric base with the crimped warp yarns extending lengthwise in the machine direction, forming an endless loop by joining two ends of the fabric in a pin-seam and fixing at least one batt layer thereto.

DETAILED DESCRIPTION OF THE PREFERRED EMBODIMENT

Figure 1:
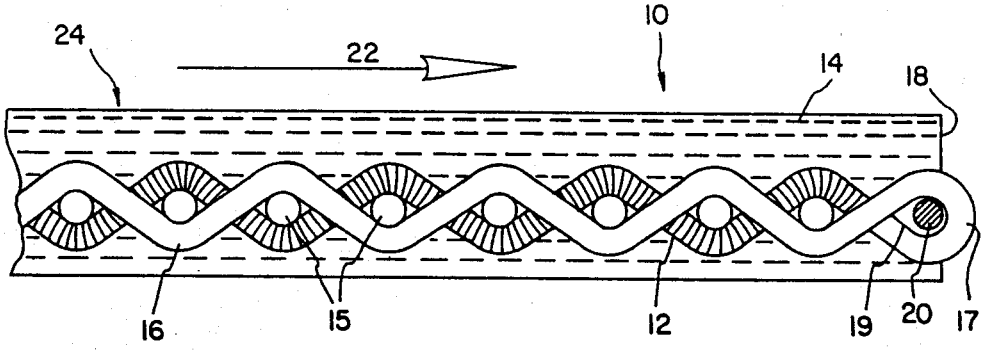
FIG. 1 is a side elevational, cross-sectional view of a portion of a wet press felt in accordance with the present invention.

Although specific forms of the invention have been selected for illustration in the drawings, and the following description is drawn in specific terms for the purpose of describing these forms of the invention, this description is not intended to limit the scope of the invention which is defined in the appended claims. In the drawings, reference numerals ending in the same integer have been used to designate similar elements in consecutive drawings.

The present invention is directed to a wet press papermaker's fabric which is flat woven and joined at a seam to form an endless loop. The wet press felt includes a base fabric in which the crimped warp yarns are oriented lengthwise so as to form the loops at the ends of the felt to be joined. The term lengthwise refers to the longitudinal direction of the flat woven fabric. By so orienting the crimped warp yarns lengthwise when the wet press felt is placed on a papermaker's machine and joined as an endless loop the crimped warp yarns extending the machine running direction. This orientation of the crimped warp yarns allows a higher machine direction yarn count for a given yarn size. Yarns counts for the present invention in the machine direction can range from about 30 to 50 yarns per inch in a single-layer weave and from about 60 to 100 yarns per inch for a double layer weave. Such high yarns counts prevent mono-stringing, increase the base fabric strength, increase compaction resistance and improve pressing uniformity due to higher elasticity in the nip. The machine direction yarn count of the present invention is approximately double a typical prior art wet press felt machine direction yarn count for a given yarn size. The wet press felt of the present invention, having crimped warp yarns oriented in the machine running direction with a batt layer or layers affixed thereto has proven to provide a wet press felt which is easier to weave, has increased seam strength, has improved pressing uniformity and sheet dewatering efficiency and superior compaction resistance.

Referring to FIG. 1, a wet press felt 10 is shown comprising a plain weave base fabric 12 to which a non-woven batt material 14 is affixed as by needling. The woven base fabric 12 is formed from weft yarns 15 and warp yarns 16. The woven base fabric 12 is formed in a plain weave pattern, as shown, with warp yarns 16 formed into loops 17 at each end 18 of the felt 10. The loops 17 are adapted to intermesh to form a passageway 19 through which pintle 20 is inserted when felt 10 is formed into an endless belt. When the felt 10 is formed into an endless felt, the warp yarns 16 are oriented lengthwise or in the machine running direction 22. Thus, the crimp of the warp yarns 16 is oriented in the machine direction 22. The warp yarns 16 and weft yarns 15 may be formed from monofilament or multi-filaments, comprising either synthetic or natural materials, however, monofilaments are preferred in the base fabric. The batt material 14 comprises non-woven fibers affixed to woven base 12 such as by needling. A batt layer may be affixed to both sides of woven base fabric 12, as shown, or a batt layer 14 maybe affixed to one side of the woven base 12 to form a working surface 24. Needling of batt layer 14 to woven base fabric 12 is generally preferred however, other fixation methods may be employed. For example, batt layer 14 may include, dispersed therein, thermoplastic filaments which serve to affix batt layer 14 to woven fabric base 12 when heated.

Figure 2:
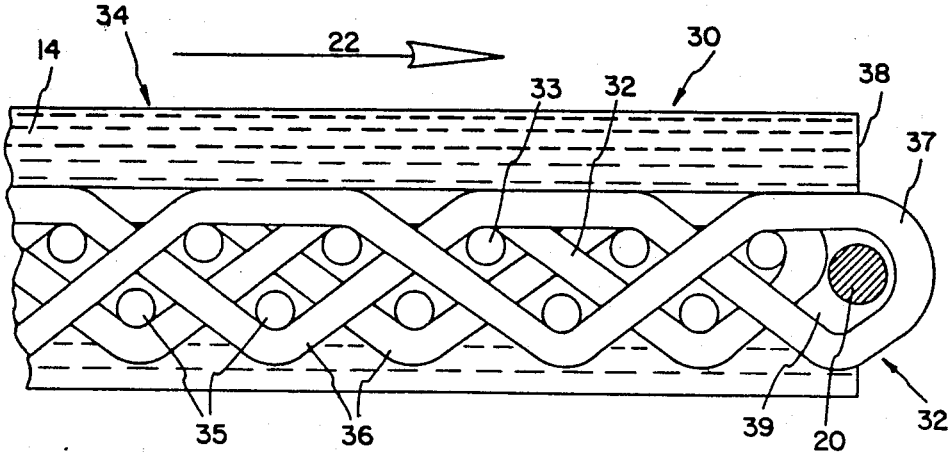
FIG. 2 is a side elevational, cross-sectional view of a portion of an alternate embodiment of a wet press felt of the present invention.

FIG. 2 illustrates an alternate embodiment of a wet press felt in accordance with the present invention. The embodiment shown in FIG. 2 comprises batt material 14 affixed, such as by needling, to a woven base fabric 32. The warp yarns 36 and weft yarns 33 and 35 can be formed from mono or multi-filaments, comprising either natural or synthetic materials. The base fabric 32 is flat woven with warp yarns 36 formed into loops 37 at the ends 38 of the felt which are to be joined when felt 30 is formed into an endless loop. The loops 37, at the ends to be joined, are adapted to intermesh, forming a passageway 39 through which a pintle 20 is inserted. When felt 30 is so joined, the crimped warp yarns 36 extend in the lengthwise or machine direction 22. The base fabric 32 is woven with warp yarns 36 forming a 2—2 repeat pattern with upper weft yarns 33 and a 3-1 repeat pattern with lower weft yarns 35. The fabric is woven on eight harness with the upper surface reflecting a float of 2 and the lower surface reflecting a plain weave, thus forming a single-ply, multi-layered fabric. If desired, the two surfaces could be mirror images. At least one layer of non-woven batt material 14 is affixed to woven base 32 such as by needling. The batt material may be affixed to both sides of the base fabric 32, as shown, or may be affixed to one side of the woven base 32 to form a working surface 34 above top surface 33 of the woven base 32.

Figure 3:
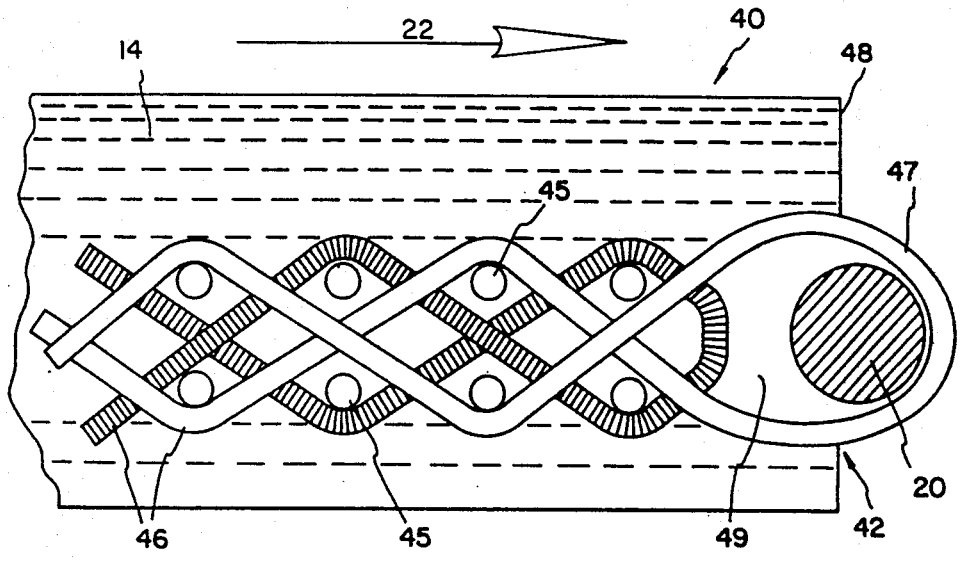
FIG. 3 is a side elevational, cross-sectional view of a portion of an alternate embodiment of a wet press felt of the present invention.

FIG. 3 illustrates an alternate embodiment of the present invention. In FIG. 3, a wet press felt 40 is formed from a flat woven base fabric 42. A non-woven batt material 14 is affixed to one or both sides of base fabric 42. Base fabric 42, as shown in FIG. 3 is a 1-3 upper layer with a mirror image 1-3 bottom layer on an 8 harness weave forming a single-ply, multi-layered fabric. The weft yarns 45 and warp yarns 46 may be either mono or multi-filaments, natural or synthetic in nature. Monofilaments are preferred for the warp 46 and weft 45 yarns of the base fabric 42. The base fabric 42 is formed with crimped warp yarns 46 extending in the lengthwise or machine direction 22. At the ends 48 to be joined, warp yarns 46 are formed into loops 47. When ends 48 are mated, intermeshing of loops 47 forms a passageway 49 through which pintle 20 may be inserted closing the seam.

Figure 4:
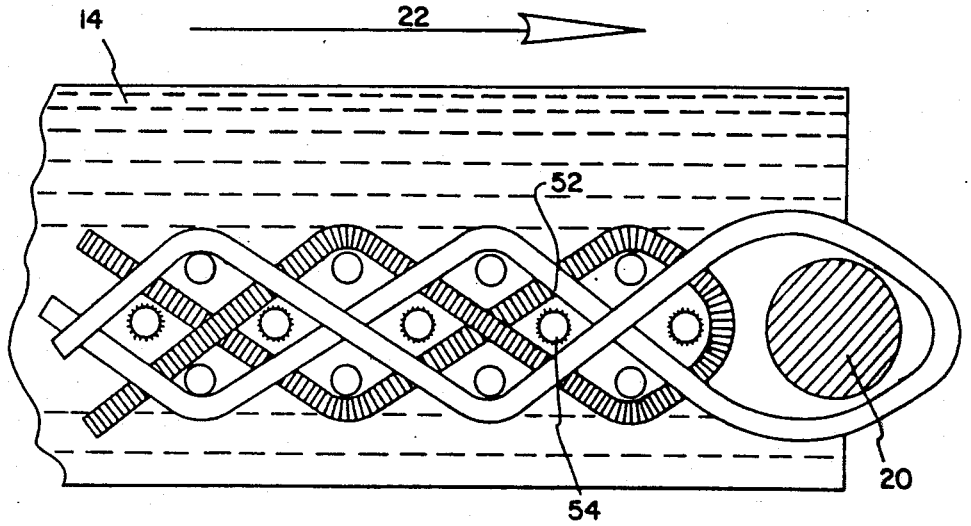
FIG. 4 is a side elevational, cross-sectional view of a portion of an alternate embodiment of a wet press felt of the present invention.

FIG. 4 illustrates alternate embodiment of the present invention. The description of the wet press felt shown in FIG. 4 is the same as the description of the wet press felt shown in FIG. 3 with the addition of stuffer yarns 54 oriented within the weave of the base fabric 52. The orientation of stuffer yarns 54 within the weave of the base fabric 52 improves compaction resistance of the wet press felt in the nip, improves void volume and also improves the fixation of batt material 14 by needling. The stuffer yarns 54 are preferably non-monofilaments and are more preferably filled or flocked yarns.

Figure 5:
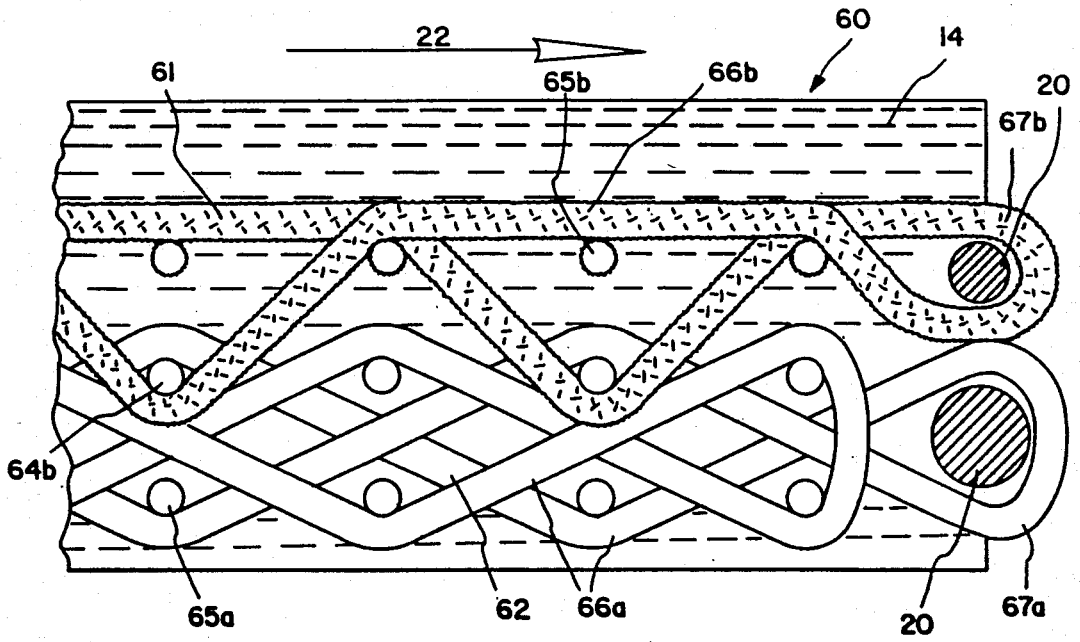
FIG. 5 is a side elevational, cross-sectional view of a portion of an alternate embodiment of a wet press felt in accordance with the present invention.

FIG. 5 illustrates an alternate embodiment of the present invention. In FIG. 5, a flat woven base fabric 62 is interwoven with a top layer 61 to which at least one layer of non-woven batt material 14 is affixed as by needling. The base fabric layer 62 is a 1-3 upper layer with mirror image 1-3 lower layer on an 8 harness weave. The upper and lower weft yarns, **64*a* and 65*a* respectively and crimped warp yarns 66*a* of base layer 62 are formed from either mono or multi-filaments, comprising synthetic or natural fibers. Monofilament yarns are preferred for both the weft 64*a* and 65*a* and warp 66*a* of base layer 62. The base fabric layer 62 is woven with the crimped warp yarns 66*a* extending in the lengthwise or machine direction 22 when the wet press felt 60 is formed into an endless loop as described below. The top layer 61 is woven from weft yarns 65b and crimped warp yarns 66*b*. Warp yarns 66*b* of top layer 61 also interweave with upper weft yarns 64*a* of base layer 62 to connect the layers forming a single-ply, multi-layered fabric. The combined layers are formed into an endless loop by forming loops 67***a* and 67*b l from warp yarns 66a* and 66*b* respectively. Bottom loops 67*a* are formed from the crimped warp yarns 66*a* of bottom layer 62 and top loops 67*b* are formed from crimped warp yarns 66*b* of top layer 61. The crimped warp yarns 66*b* and weft yarns 65*b* of top layer 61 are formed from a soft-filament or spun yarn to provide a cushioned working surface. The felt 60 is formed into an endless loop by interconnecting loops 67*a* and 67*b* and inserting pintles 22 in a manner known to a person of ordinary skill in the art. Layers of non-woven batt material 14 are affixed to the interconnected layers as by needling.

Figure 6:
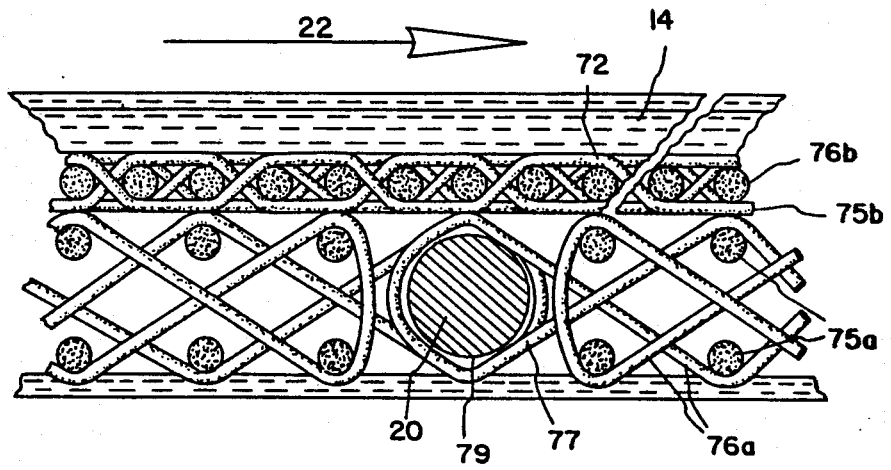
FIG. 6 is a side elevational, cross-sectional view of a portion of an alternate embodiment of a wet press felt in accordance with the present invention.

FIG. 6 illustrates an alternate embodiment of the present invention. In FIG. 6, a flat woven base fabric 70 is formed from a 1-3 upper layer and a mirror image 1-3 lower layer on an 8 harness weave forming a single-ply, multi-layered fabric. The base fabric 70 is flat woven from weft yarns 75*b* and crimped warp yarns 76*b*. Bottom layer 70 is provided with end loops 77 formed from crimped warp yarns 76*a*. End loops 77 are adapted to be intermeshed, forming a passageway 79 through which pintle 20 is inserted, thereby forming an endless loop. When bottom layer 70 is formed into an endless loop, crimped warp yarns 76*b* are oriented in the machine direction. Top layer 71 comprises a 2—2 single layer endless weave. The endless loop is cut, as at 72, to allow the wet press felt to be joined at a seam. The warp yarns 76*b* of top layer 71 extend in the cross-machine direction and weft yarns 75*b* extend in the lengthwise or machine direction 22. Top layer 71 is oriented about bottom layer 72, and thereafter non-woven batt material 14 is affixed thereto as by needling. The fixation of non-woven batt material 14 to layer 71 also interconnects layers 71 and 72 as well as provides the working surface for the wet press felt.

It should be understood that the foregoing description and drawings of the invention are not intended to be limiting, but are only exemplary of the inventive features which are defined in the claims.

What I claim is:

1. A papermaker's wet press felt which is rendered endless by intermeshing seaming loops, extending from respective ends of a base fabric of said felt, and inserting a pintle in the resulting channel formed by the loops, said felt comprising:

(a) the base fabric being a multi-ply fabric which was flat woven in a selected repeat pattern with crimped warp yarns oriented lengthwise in the loom and further oriented in the felt running direction during use on the papermaking machine;

(b) said crimped warp yarns being woven at least 60 to 100 yarns per inch;

(c) each of said seaming loops, at the respective ends of said felt, being a portion of a selected one of said crimped warp yarns of said base fabric which extends beyond the respective end of said woven base fabric and is retained in said base fabric by said selected repeat pattern, said seaming loops extending in the lengthwise or felt running direction when said loops are intermeshed at the seam; and (d) at least one layer of batt material affixed to said base fabric.

2. The papermaker's wet press felt of claim 1, further comprising a second fabric layer superimposed around said flat woven base fabric.

3. The papermaker's wet press felt of claim 1, wherein said batt material is a non-woven material needled to said base fabric.

4. A papermaker's wet press felt which is rendered endless by intermeshing seaming loops, extending form respective ends of a base fabric of said felt, and inserting a pintle in the resulting channel formed by the loops, said felt comprising:

(a) the base fabric being a single layer fabric which was flat woven in a selected repeat pattern with a single layer of crimped warp yarns oriented lengthwise in the loom and further oriented in the felt running direction during use on the papermaking machine;

(b) said base fabric having at least 30 to 50 crimp warp yarns per inch;

(c) each of said seaming loops, at the respective ends of said felt, being a portion of a selected one of said crimped warp yarns of said base fabric which extends beyond the respective end of said woven base fabric and is retained in said base fabric by said selected repeat pattern, said seaming loops extending in the lengthwise or felt running direction when said loops are intermeshed at the seam; and (d) at least one layer of batt material affixed to said base fabric.

* * * * *

UNITED STATES PATENT AND TRADEMARK OFFICE

CERTIFICATE OF CORRECTION

PATENT NO. : 4,892,781

DATED : January 9, 1990

INVENTOR(S) : Patrick H. Penven

It is certified that error appears in the above-identified patent and that said Letters Patent is hereby corrected as shown below:

Column 1, line 62, delete the word "to" and insert therefor --of--.

Column 2, line 11, delete the word "generally" and insert therefor --general--.

Column 2, line 34, delete the word "that" and insert therefor --than--.

Column 2, line 36, after the word "press" insert --felt--.

Column 3, line 16, delete the word "extending" and insert the words therefor --extend in--.

Column 3, line 56, delete the word "maybe" insert the words therefor --may be--.

Column 5, line 3, delete the italicized letter "*l*".

Column 5, lines 3 and 4, the words "from warp yarns" should not be italicized.

UNITED STATES PATENT AND TRADEMARK OFFICE

CERTIFICATE OF CORRECTION

PATENT NO. : 4,892,781

DATED : January 9, 1990

INVENTOR(S) : Patrick H. Penven

It is certified that error appears in the above-identified patent and that said Letters Patent is hereby corrected as shown below:

Claim 4, column 6, line 25, delete the word "form" and insert therefor --from--.

Signed and Sealed this

Second Day of April, 1991

*Attest:*

*Attesting Officer*

HARRY F. MANBECK, JR.

*Commissioner of Patents and Trademarks*